US007296405B2

(12) United States Patent
Negre et al.

(10) Patent No.: US 7,296,405 B2
(45) Date of Patent: Nov. 20, 2007

(54) VARIABLE FLOW REDUCING VALVE AND GRADUAL CONTROL VALVE DISTRIBUTION SYSTEM FOR A COMPRESSED AIR INJECTION ENGINE OPERATING ON MONO OR MULTI ENERGY AND OTHER ENGINES OR COMPRESSORS

(75) Inventors: Guy Negre, Carros Cedex (FR); Cyril Negre, Carros Cedex (FR)

(73) Assignee: MDI Motor Development International S.A. (LU)

( * ) Notice: Subject to any disclaimer, the term of this patent is extended or adjusted under 35 U.S.C. 154(b) by 73 days.

(21) Appl. No.: 10/512,156

(22) PCT Filed: Apr. 22, 2003

(86) PCT No.: PCT/FR03/01265

§ 371 (c)(1),
(2), (4) Date: May 3, 2005

(87) PCT Pub. No.: WO03/089764

PCT Pub. Date: Oct. 30, 2003

(65) Prior Publication Data

US 2005/0224059 A1 Oct. 13, 2005

(30) Foreign Application Priority Data

Apr. 22, 2002 (FR) ..... 02 05010

(51) Int. Cl.
*F16D 31/02* (2006.01)
*F01L 1/34* (2006.01)

(52) U.S. Cl. ..... 60/370; 91/331; 123/90.16

(58) Field of Classification Search ..... 60/370; 91/303, 331–333, 348–349, 354; 123/90.15–90.17, 123/90.2, 90.27, 90.31, 90.41, 90.44, 90.47
See application file for complete search history.

(56) References Cited

U.S. PATENT DOCUMENTS

| | | | | |
|---|---|---|---|---|
| 310,310 | A * | 1/1885 | Pitchford | 91/324 |
| 3,641,988 | A | 2/1972 | Torazza et al. | |
| 4,762,098 | A | 8/1988 | Tamba et al. | |
| 5,456,224 | A * | 10/1995 | Riley | 123/90.16 |
| 2001/0002379 | A1 | 5/2001 | Schechter | |

FOREIGN PATENT DOCUMENTS

| | | | |
|---|---|---|---|
| DE | 396065 | C | 5/1924 |
| FR | 511513 | A | 12/1920 |
| FR | 849794 | A | 1/1939 |

* cited by examiner

*Primary Examiner*—Michael Leslie
(74) *Attorney, Agent, or Firm*—Connolly Bove Lodge & Hutz LLP

(57) ABSTRACT

A variable flow reducing valve and distribution system is disclosed for compressed air injection engines operating on mono or dual energy with dual or triple supply mode and comprising a high pressure compressed air tank and a buffer capacity. The system can control the stroke of an engine piston and stop the piston at the dead centre. Moreover, the air supply in the buffer capacity and to the cylinders is controlled by pilot valves. A cam for the pilot valves is positioned directly on the flanges of a crankshaft and drives the rocker arm rods to pivot rocker arms around corresponding mobile shafts that can move between two ends of the rocker arms, thereby controlling lifting of the pilot valves according to the movement of the rocker arm rods.

20 Claims, 6 Drawing Sheets

VARIABLE FLOW REDUCING VALVE AND GRADUAL CONTROL VALVE DISTRIBUTION SYSTEM FOR A COMPRESSED AIR INJECTION ENGINE OPERATING ON MONO OR MULTI ENERGY AND OTHER ENGINES OR COMPRESSORS

The invention concerns a distribution system using valves notably for engines, and more specifically, for those powered by the injection of additional compressed air, comprising a compressed air tank and operating on mono or dual energy with dual or triple supply mode and on multi-energy. The invention is also suitable for use with conventional internal combustion engines and compressors.

The term engine distribution system refers to all the means used for opening and closing the pipes for the purpose of letting in and/or letting out the fluids or gases required for the engine or the compressor to work.

There are distribution systems made up of rocker arms mounted on a fixed pin. One of the ends of the aforesaid rocker arm receives the driving thrust via a rocker arm rod, itself controlled via a cam mounted on a shaft driven via the engine crankshaft; the other end is activated so that it pushes open the valve. The lever arm ratio thus formed determines the lifting of the valve for a given movement of the rocker arm rod.

The author has registered numerous patents relating to motor drive units as well as their installations, using additional compressed air to give a totally clean operation in urban and suburban areas:

WO 96/27737 WO 97/00655
WO 97/48884 WO 98/12062 WO 98/15440
WO 98/32963 WO 99/37885 WO 99/37886

For implementing these inventions, he has also described in his application for patent WO 99/63206, the contents of which can be referred to, a method and a device for controlling the engine piston movement making it possible to stop the piston at its top dead centre; method also described in his application for patent WO 99/20881, the contents of which can also be referred to, relating to the operating of these engines on single-energy or dual-energy, in dual or triple feed modes.

According to a preferred mode, the engine unit is fitted with moving elements (crank piston rod system) comprising a device for controlling the engine piston movement such as is described in patent WO 99/20881, the contents of which can be referred to. The aforesaid device is characterized by the fact that the piston is held in its top dead centre position for a period of time, therefore for a significant angular sector during rotation. This is used at constant volume to carry out:

- operations for transferring gas and/or compressed air, and for stopping the piston at its top dead centre.
- ignition and combustion operations in the case of standard engines.
- fuel injection operations in the case of diesel engines.
- end of exhaust, and beginning of intake operations for all engines and compressors.

So that the piston can be stopped at its top dead centre, it is controlled by a pressure lever device, itself controlled by a crank piston rod system. The tern pressure lever refers to a system of two hinged arms. The end of one of the aforesaid arms, known as a pivot, is stationary and the other can move along an axis. If a force, more or less perpendicular to the axis of the two arms when they are aligned, is applied to the joint between these two arms, the free end will then move. This free end is linked to the piston and controls its movements. The piston is at its top dead centre when the two hinged rods are essentially in line with one another (around 180°).

The crankshaft is linked via a control rod to the hinge pin for the two arms The way the different elements are positioned and their sizes make it possible to modify the characteristics of the assembly kinematics. The positioning of the stationary end determines an angle between the travel axis of the piston and the axis of the two arms when they are aligned. The positioning of the crankshaft determines an angle between the control rod and the axis of the two arms when they are aligned. Varying the values of these angles, together with the lengths of the connecting rods and arms, makes it possible to determine the crankshaft rotation angle during which the piston is stopped at its top dead centre. This corresponds to the length of time for which the piston is stopped.

According to a particular embodiment, the device assembly (piston and pressure lever) is balanced with its lower arm extended beyond its stationary end or pivot against a mirror-image pressure lever working in the opposing direction. This symmetrical pressure lever with identical inertia has an identical inertial weight facing in the opposing direction to that of the piston fixed to it; said inertial weight is capable of travelling along an axis parallel to the travel axis of the piston. The term inertia refers to the product of the weight multiplied by the distance between its centre of gravity and the reference point in the case of a multi-cylinder engine, the opposing weight can be a piston operating in the same way as the piston that it balances.

The device according to the invention described in the application for French patent 01/13798 preferably uses this provision which is characterized in that the axis of the opposing cylinders and the fixed point of the pressure lever are essentially aligned along the same axis. It is characterized in that the pin for the control rod linked to the crankshaft is positioned, not on the pin common to the hinged arms but on the arm itself between the common pin and the fixed point or pivot. Therefore, the lower arm and its symmetry form a single arm swinging, essentially in its centre, on a pivot or fixed point with two pins at each of its free ends linked to the opposing pistons via connecting rods.

In these types of engine operating with compressed air and comprising a high-pressure compressed air tank, the compressed air contained at high pressure in the tank has to be expanded but, as the tank is drained, the air pressure is reduced to a stable intermediary pressure known as the final use pressure in a buffer capacity prior to being used in the master cylinder(s). The conventional, well-known gate and spring pressure reducers have extremely low flowrates, and their use for this application requires extremely heavy-duty, inefficient appliances; plus the humidity in the air cooled during decompression is highly likely to cause them to ice up.

The distribution system according to the invention which uses a cam, rocker arm and rocker arm rod assembly, on the one hand, acts as a variable flow pressure reducer, as a simplified camshaft-less control and as the drive system (chain, belt, pinion gears), and on the other hand, adjusts the lifting of the valve and the angular spread of the aforesaid opening from maximum lifting through to zero lifting thereby making it possible to ensure that the filling and/or draining flowrate of the cylinder in question is controlled and that the accelerator butterfly control is advantageously replaced. It is characterized in that the air supply in the final use buffer capacity and the supply to the cylinders are ensured by pilot valves where:

the cams of the aforementioned pilot valves, which are used to control the rocker arm rods, are positioned directly on the flanges of the crankshaft;

the aforesaid cams activate one or more pressure levers which control the movement of the rocker arm rods.

Each rocker arm, one end of which receives the driving thrust whilst the other activates the valve, pivots around a mobile pin that can move between the two ends thereof, thereby enabling the changing of the lever arm ratio which determines the lifting of the valve according to the movement of the rocker arm rod.

When the swivel pin for the rocker arm is positioned close to the control rod, the lifting of the valve is at its maximum, when the pin is positioned halfway along, the lifting of the valve is equal to the movement of the control rod and when it is close to the valve, the lifting of the valve is less than the movement of the control rod.

Preferably, the rocker arm is essentially in the shape of an arc of a circle, one end of which activates the valve whilst the other end is linked to the control rod, known as the rocker arm rod, and pivots around a mobile pin fitted with the means to enable it to move through the arc of a circle in a slotted hole, and according to an arc of an essentially concentric circle. This thereby enables the changing of the ratio of the aforesaid rocker arm lever arms which are located on either side of the mobile pin, and which thus determine the lifting of the valve according to the movement of the control rod.

Preferably, the contact area of the aforesaid rocker arm on the valve is made up of an arc of a circle having as its axis the position of the rocker arm swivel pin when it is in its smallest possible opening position close to the valve thus enabling the rocker arm pivoting on the same pin to stop exerting pressure on the valve and keep the valve closed during the pivoting of the rocker arm.

Advantageously, the rocker arm pin is moved by a yoke supporting the mobile pin. It is mounted on the same pin as the arc of the circle from the mobile pin slotted hole and is driven by mechanical, electrical or hydraulic means.

This control can be directly linked to the accelerator pedal of the vehicle making it possible to gradually increase the lifting of the valve(s) and regulate the amount of gas let into the buffer capacity —whilst maintaining a constant pressure—then into the master cylinders.

In the case of an electric control, for example by one or more stepper motors, the mechanical controls for the traditional accelerator can be removed and an electronic control unit used with a suitable cartography to control the lifting of the valves for all the selected parameters according to the pressure in the storage tank and the pressure in the buffer capacity, the position of the accelerator, the requested torque, the required speed or other conditions.

The advantages of the distribution system according to the invention are then clear. In addition to its role of opening and closing the pipes, the distribution system makes it possible to replace the accelerator device customary to engines, by keeping the engine valve(s) closed so that they can then be opened via gradual lifting according to the required filling and/or draining needs, moreover the effort required by the opening device is proportional to the lifting of the valve.

Preferably, and notably in the case of an opposed piston engine, the moving of the rocker arm rods is controlled by a pressure lever made up of two hinged arms, the common end of which comprises a means of contact, ball bearings or other, which is driven back by the cam housed on the flange of the crankshaft.

The distribution system according to the invention particularly applies to compressed air engines. However, it can be used for traditional engines or compressors, in the same way that the rocker arm rod can be controlled by a camshaft, where the camshaft can directly activate the rocker arm.

Other objects, advantages and features of the invention will become apparent upon reading the nonlimiting description of a number of embodiments which are given with reference to the appended drawings where:

Figure 1:
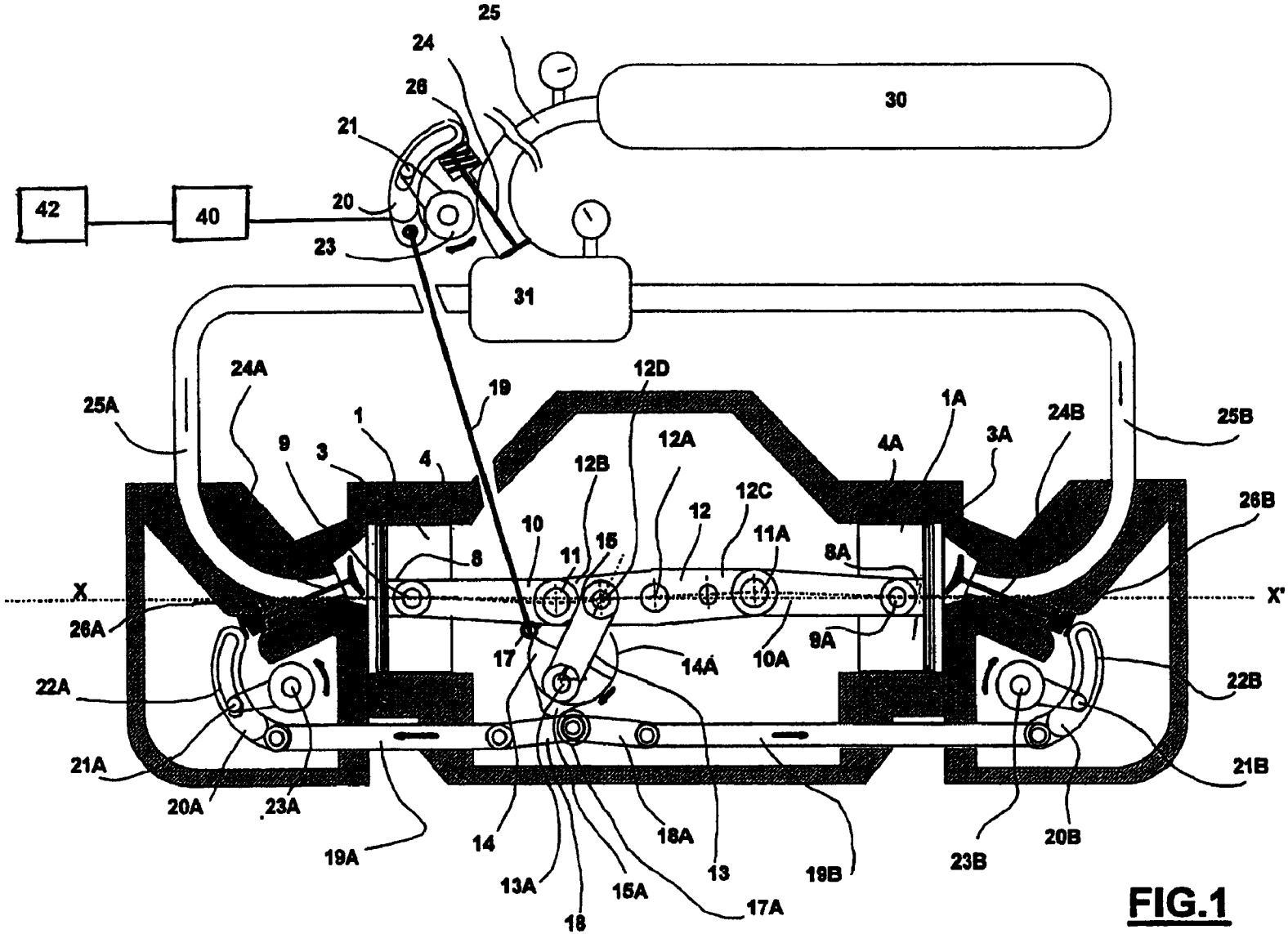
FIG. 1 is a diagrammatic depiction in cross section of an engine fitted with the distribution system according to the invention when the valve lifting control is at its maximum, at the end of letting air in during filling.
Figure 2:
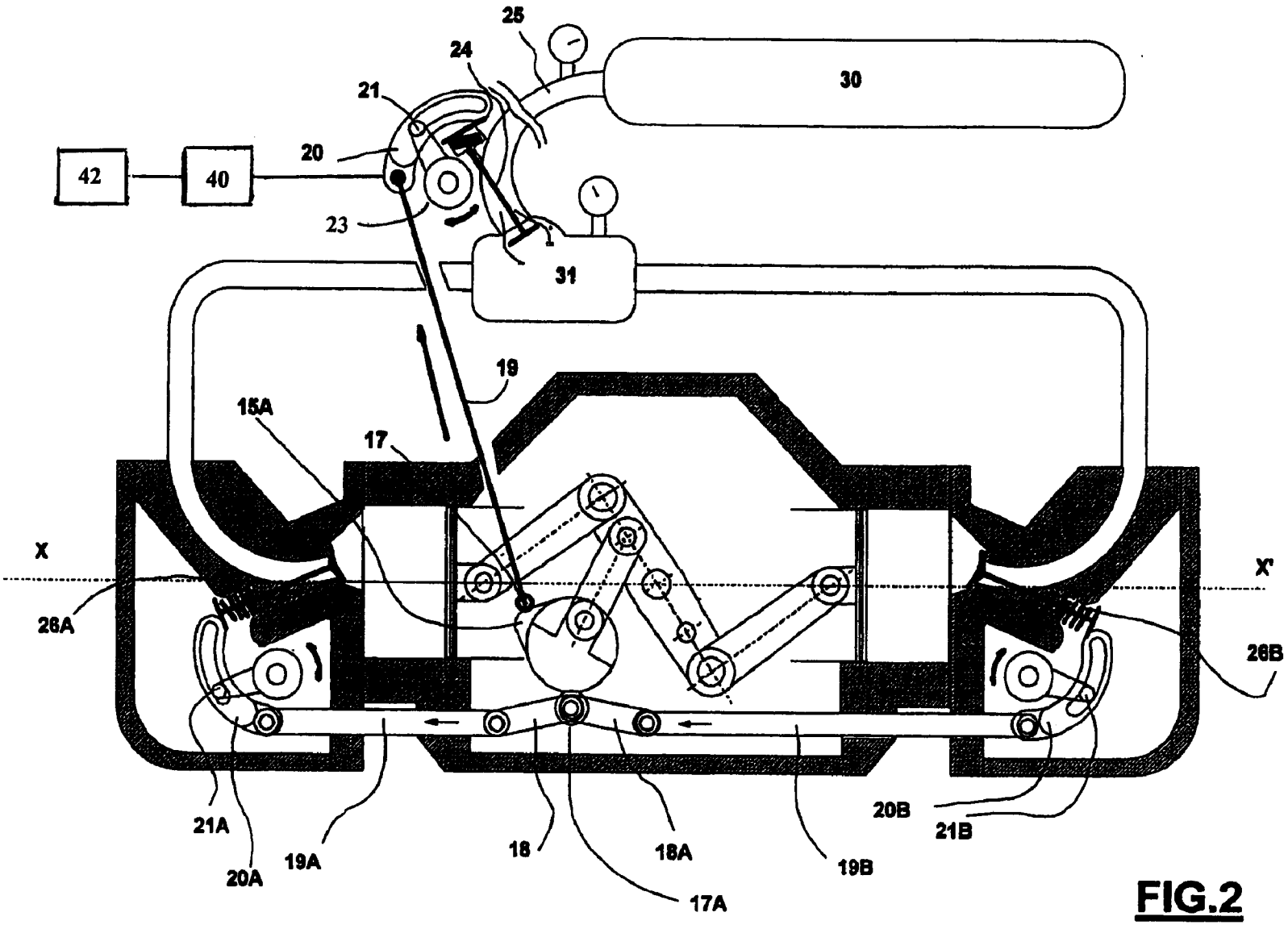
FIG. 2 depicts this same engine during the expansion and exhaust strokes.
Figure 8:
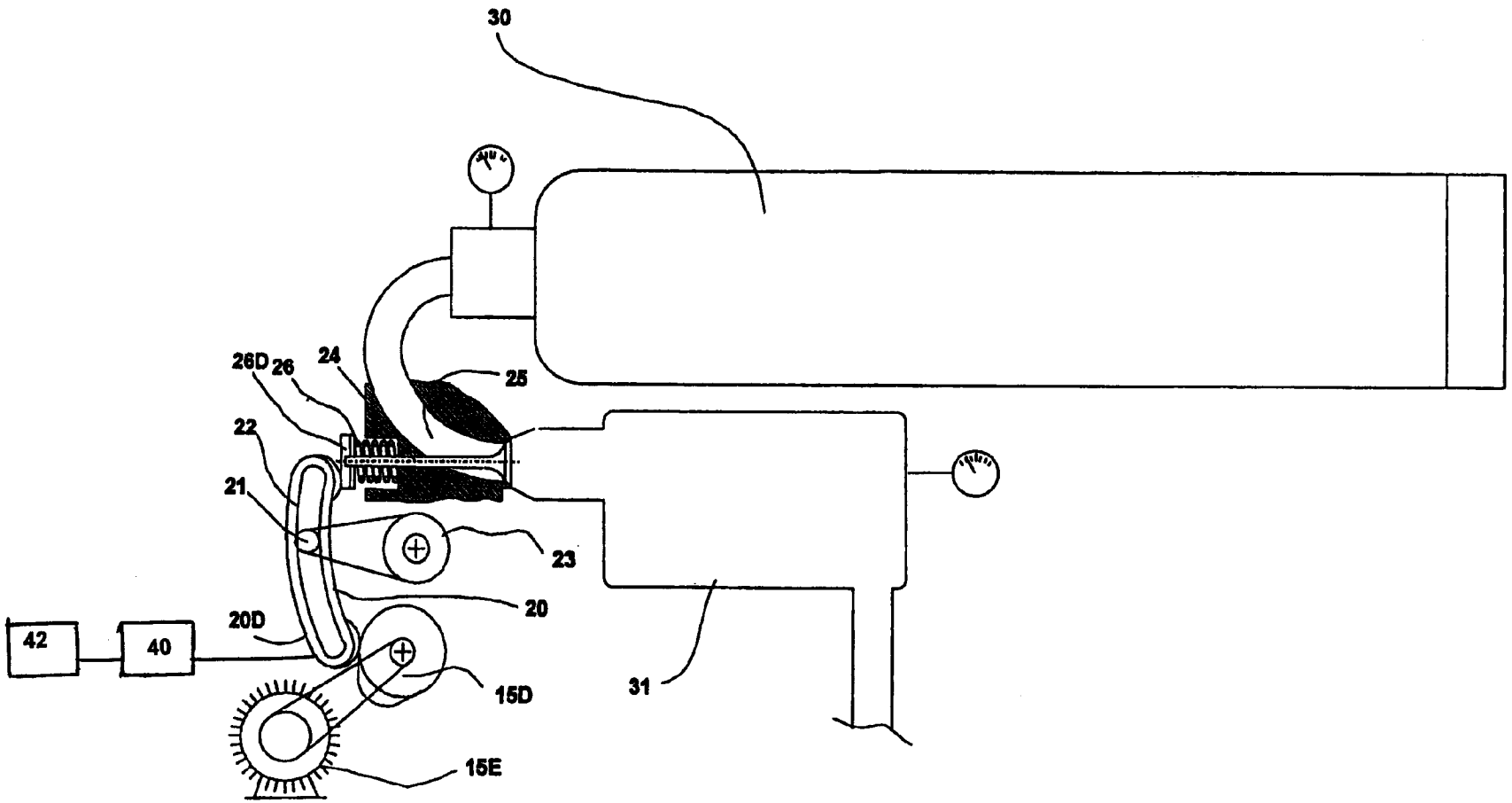

FIG. 8 is a diagrammatic depiction of an independent pressure reducing device for miscellaneous applications, FIGS. 1 and 2 are diagrammatic depictions in cross section of the architecture for the moving elements of an engine fitted with the distribution system according to the invention comprising two essentially opposing pistons and cylinders on the same XX' axis where it is possible to see the pistons 1 and 1A equipped with their piston ring seals 3 and 3A and sliding into their cylinder 4 and 4A, each piston also comprising bosses 8 and 8A making it possible to connect them via a pin, called the piston pin, 9 and 9A to the crank piston rod system via the connecting rods 10 and 10A, themselves connected via a common pin 11 and 11A to the two free ends of an arm 12 mounted so that it swings, essentially in its centre, on a fixed pin 12A, located essentially along the axis of the cylinders X,X'; the fixed pin 12A thus divides the arm 12 into two half-arms 12B and 12C. On one of the two half-arms, here the 12B, a control rod 13, connected to the crankpin 13A of a crankshaft 14 turning on its pin 15, is attached via a pin 12D. During the rotation (direction of the arrow) of the crankshaft, the control rod 13 applies a force to the pin 12D, causing the swinging arm 12 to move, thus allowing the pistons 1 and 1A to travel along the axis of the cylinders 4, 4A, or even the axis XX' of the bottom dead centre (FIG. 2) to the top dead centre (FIG. 1), and on its backstroke, it transmits the forces applied to the pistons 1 and 1A during the power stroke from the top dead centre to the bottom dead centre to the crankshaft 14 thus generating the rotation of the aforesaid crankshaft. When the pistons are at their top dead centre (FIG. 1) the connecting rods 10 and 10A and the swinging arm 12 are essentially aligned along axis XX'. In this position the distance between the crankpin 13A of the crankshaft and the axis XX' is essentially identical during part of the rotation of the crankshaft thus controlling the travel of the pistons which remain stopped at their top dead centre for a significant angular sector of the crankshaft rotation.

Advantageously, the rocker arm 20 is moved by a yoke 23 supporting the mobile pin 21. It is mounted on the same pin as the arc of the circle from the mobile pin slotted hole and is driven by mechanical, electrical or hydraulic 40.

This control can be directly linked to the accelerator pedal 42, as shown in FIG. 1, FIG. 2 and FIG. 8, of the vehicle making it possible to gradually increase the lifting of the valve(s) and regulate the amount of gas let into the buffer capacity—whilst maintaining a constant pressure—then into the master cylinders.

In the case of the means 42 being an electric control, for example by one or more stepper motors, the mechanical controls for the traditional accelerator can be removed and an electronic control unit used with a suitable cartography to control the lifling of the valves for all the selected parameters according to the pressure in the storage tank 30 and the pressure in the buffer capacity 31, the position of the 42, the requested torque, the required speed or other conditions.

The engine depicted is fitted with the distribution system according to the invention where it is possible to see the control cam 15A housed on the flange 14A of the crankshaft 14. Along the periphery of the aforesaid crankshaft runs, on the one hand, a roller 17 which controls a rocker arm rod 19 which controls the pivoting of a rocker arm 20 around its mobile pin 21 that can move through the arc of a circle in a slotted hole 22 housed in the rocker arm when it is activated by a rotating, alternating control 23 which has the same radius and the same axis as the slotted hole 22. This rocker arm controls the opening of a valve 24 to allow the opening and closing of the pipe 25 which links the high pressure storage tank 30 and the final use buffer capacity 31; a return spring 26 allows the valve 24 to close when it is not being opened by the rocker arm 20. And, along the periphery of the aforesaid crankshaft runs, on the other hand, a roller 17A mounted on the common pin of a pressure lever made of two arms 18 and 18A, the common ends of which are in the axis of the roller 17, and the free ends of which are linked to two rocker arm rods 19A and 19B which control the pivoting of the rocker arms 20A and 20B around their mobile pin 21A that can move through the arc of a circle in slotted holes 22A and 22B, housed in the rocker arms, when they are activated by their rotating, alternating controls 23A, 23B which have the same radius and the same axis as their slotted holes 22A, 22B. The rocker arms 20A, 20B control the opening of the valves 24A and 24B to allow the opening of the pipes 25A, 25B and the springs 26A, 26B are used to close the pipes 25A, 25B by returning the valves to their seating when they are no longer being opened by the rocker arms.

When the pistons are at their top dead centre, FIG. 1, the rotation of the cam 15A drives back the roller 17A which activates the pressure lever arms 18 and 18A so that they move the rocker arm rods 19 and 19A in the direction of the arrows. The aforesaid rocker arm rods pivot the rocker arms 20A and 20B around the mobile pins 21A and 21B, driving back the valves 24A and 24B to let the compressed air from the pipes 25A and 25B into the cylinders 4 and 4A. In this figure, the mobile pins 21A and 21B of the rocker arms are positioned as close as possible to the rocker arm rods in the slotted holes. Under these conditions, the distance between the mobile pin and the rocker arm rod thrust point is less than the distance between the mobile pin and the contact of the rocker arm on the valve, and the movement of the valves 24A, 24B will be greater than that of the rocker arm rods 19A, 19B, lifting the valves higher and improving the filling the cylinders.

As the crankshaft continues to rotate. FIG. 2, the cam 15A disappears in front of the roller 17 and the springs 26A and 26B return the valves to the closed position by driving back the rocker arms which, pivoting on their mobile pins 21A, 21B, drive back the rocker arm rods 19A, 19B and the pressure lever arms 18, 18A in the direction of the arrows, thus making it possible for the cylinder to close during the expansion and exhaust strokes (the exhaust system is not shown in these figures). In its rotation, the cam 15A drives back the roller 17 which moves the rocker arm rod 19 in the direction of the arrow. This then pivots the rocker arm 20 around its mobile pin 21 driving back the valve 24 to let compressed air from the high pressure storage tank 30 through pipe 25 into the buffer capacity 31 at final use pressure enabling this capacity 31 to be maintained at a virtually constant pressure.

Figure 3:
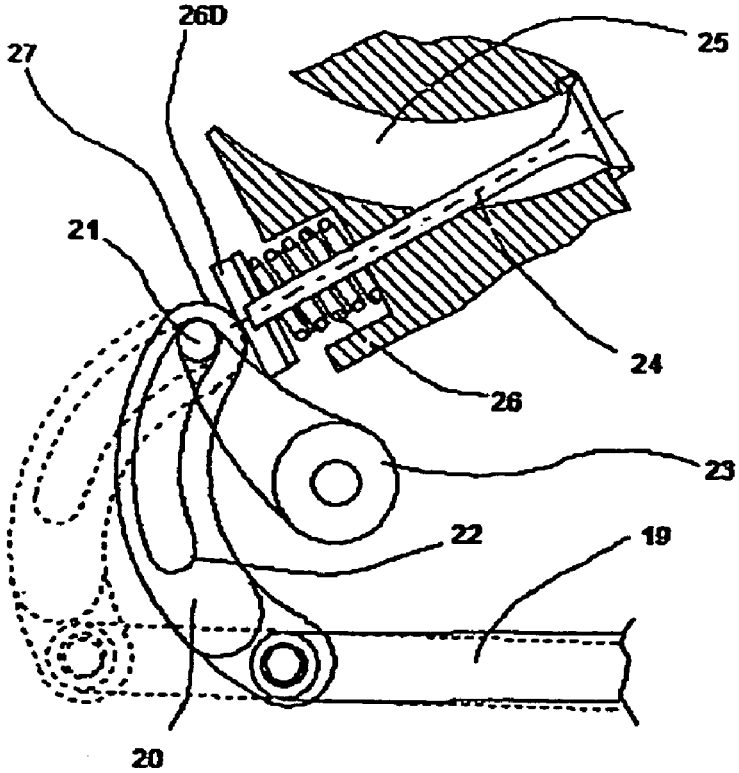
FIG. 3 is a detailed depiction of the distribution system on the same engine showing notably the kinematics of the rocker arm in its valve constantly closed position.

FIG. 3 is a detailed diagrammatic depiction of a rocker arm and its control according to the invention, where the contact area of the rocker arm 20 on the pushrod 26D of the stem of the valve 24, forms an arc of a circle 27 with the same axis as the mobile pin 21 when it is positioned as close as possible to the valve 24; when the rocker arm pivots around its mobile pin during the movement of the rocker arm rod 19, position depicted by dotted lines, the contact area 27 of the rocker arm operates in a circle around the mobile pin 21 and does not generate any movement in the valve 24 thus keeping the pipe closed.

Figure 4:
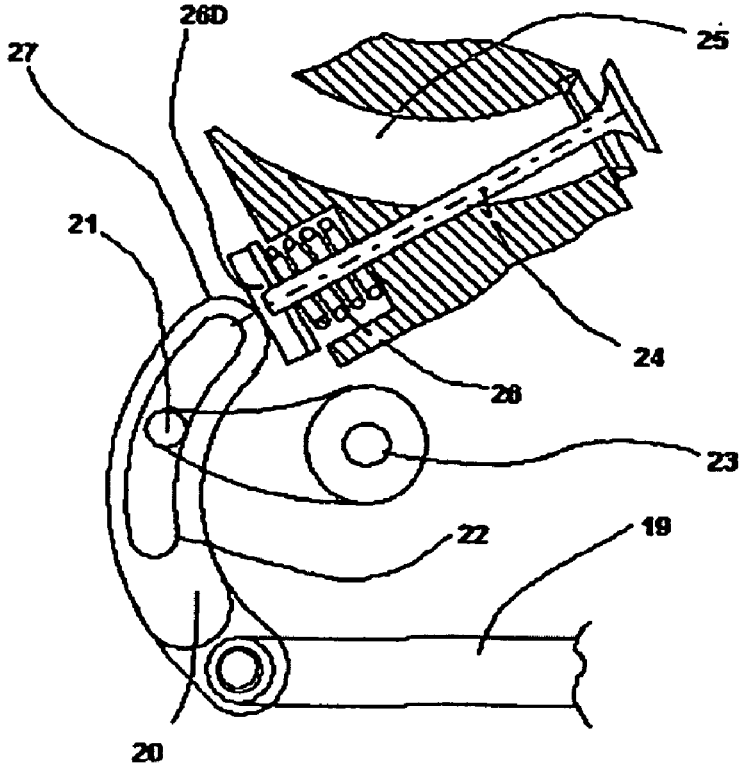
FIG. 4 is a detailed depiction of the distribution system whilst letting air in with the valve in a half-open position.

FIG. 4 is a detailed depiction of the elements of the distribution system according to the invention where the mobile pin 21 is positioned half-way between the contact point of the rocker arm rod 19 and the activation point 27 of the rocker arm on the valve 24.

When the control 23 for the mobile pin 21 of the rocker arm 20 moves, FIG. 4, the ratio of the lever arms located on either side of the aforesaid mobile pin 21 determines a pivoting of the rocker arm 20 which opens the valve 24 according to the movement of the rocker arm rod 19. In FIG. 4, the swivel pin is shown essentially at the centre of the rocker arm and the lifting of the valve 24 is therefore essentially equal to the movement of the rocker arm rod 19. It is therefore possible with this device to authorize valves to be gradually lifted; starting from zero lift which corresponds to the engine being turned off and finishing with maximum lift, defined by the geometric construction of the distribution system, thus piloting the engine according to requirements.

Figure 5:
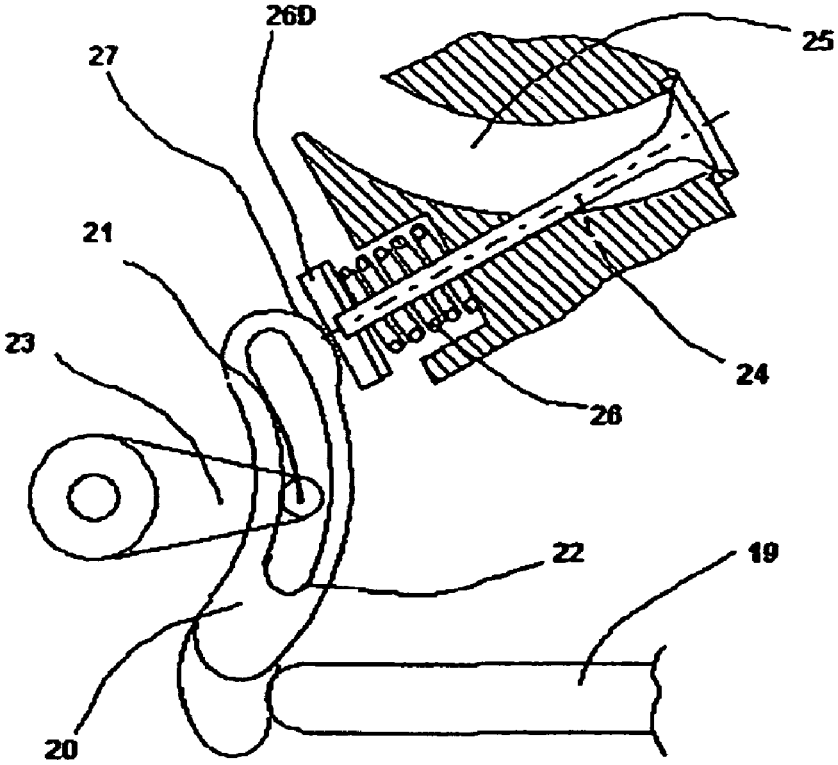
FIG. 5 is a detailed depiction of the distribution system in the opposing control position

FIG. 5 is a detailed depiction of a variation of the elements of the distribution system according to the invention where the arc of the circle formed by the rocker arm 20 and the control 23 for the mobile pin 21 of the rocker arm 20 is in an opposing position to the valve 24.

Figure 6:
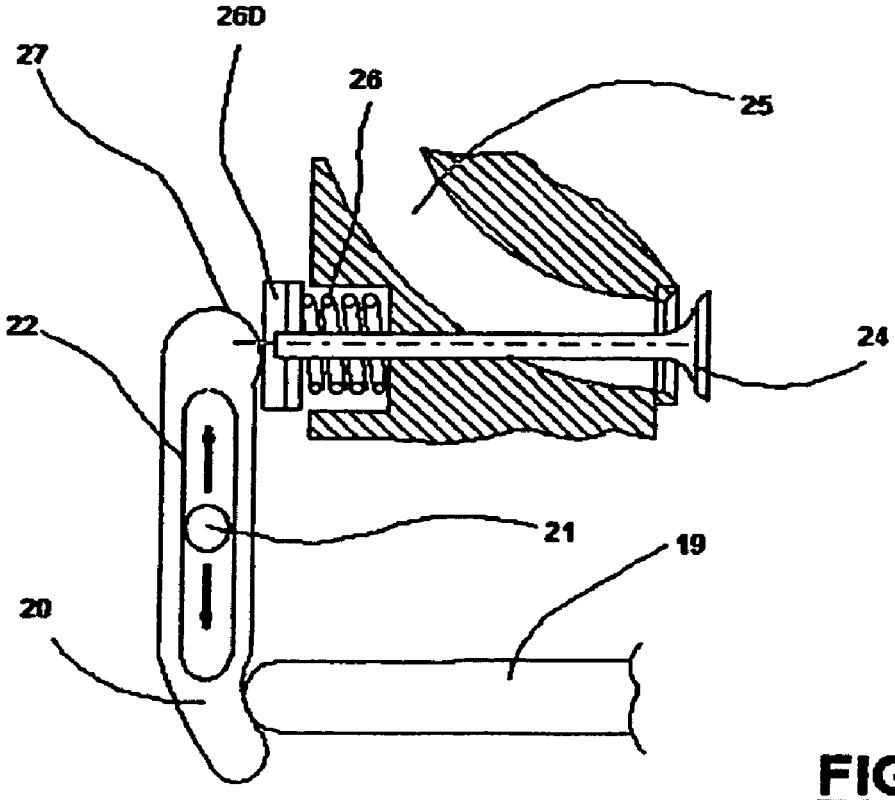
FIG. 6 depicts a variation of the rocker arm according to the invention.

FIG. 6 depicts a variation of the embodiment of a rocker arm according to the invention where the rocker arm 20 and its slotted hole 22 are rectilinear.

Figure 7:
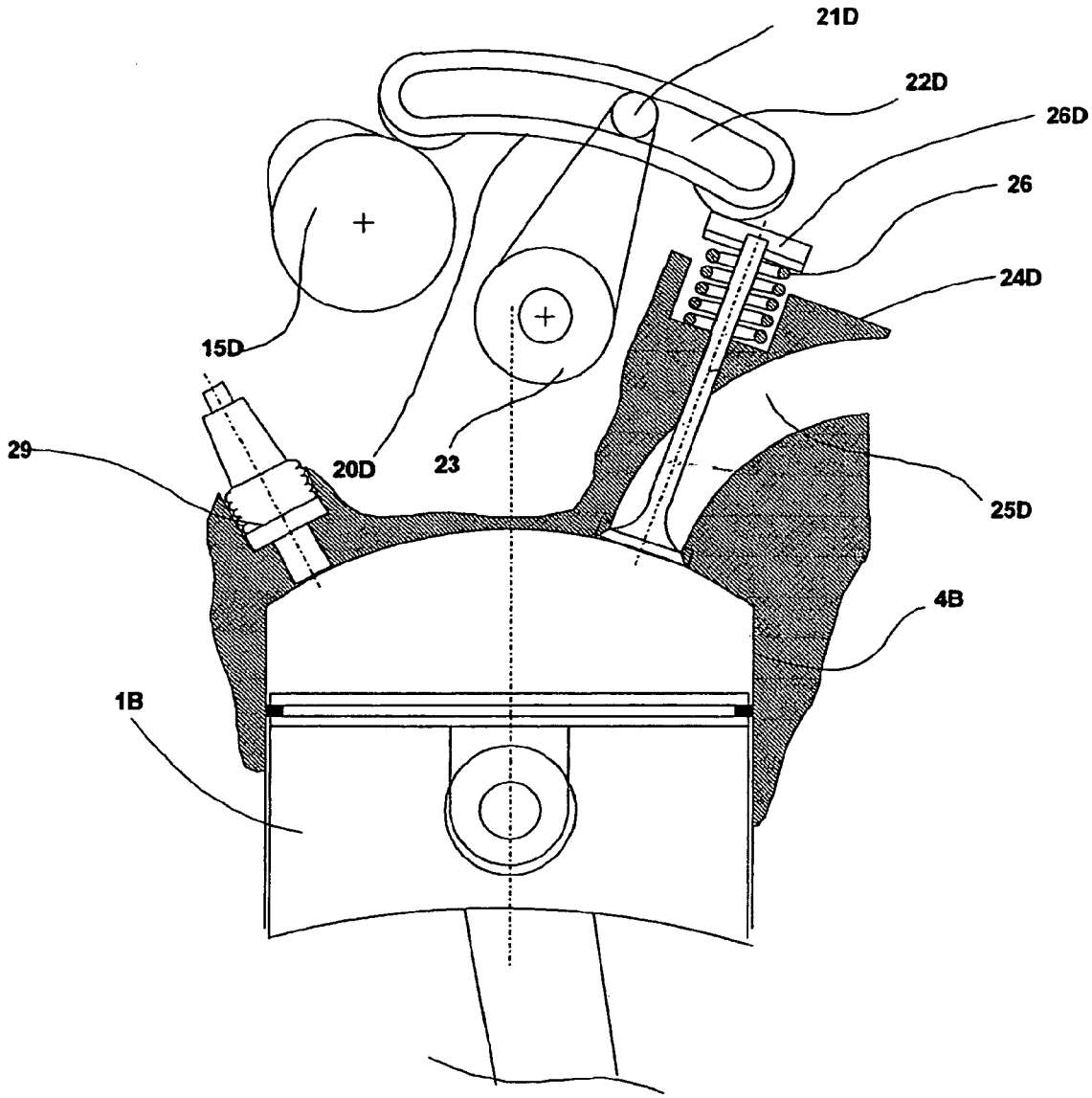
FIG. 7 is a diagrammatic depiction in cross section of the control device according to the invention adapted for a conventional engine with an overhead camshaft.

FIG. 7 depicts the distribution system according to the invention adapted for a traditional engine where it is possible to see in diagrammatic section a piston 1B sliding into a cylinder 4B, with an overlying combustion chamber wherein fits a spark plug 29, fed by an inlet pipe 25D and a valve 24D) activated by a rocker arm 20D pivoting around a mobile pin 21D positioned in the slotted hole 22D of the rocker arm. An overhead camshaft 15D, driven by the engine at half crankshaft (not shown) speed, rotates thus giving a thrust to the rocker arm 20D which pivoting on its mobile swivel pin 21D activates the valve 24D according to the laws governing opening for the engine in question. The device according to the invention as described above authorizes the engine to operate from off and/or idling mode through to its maximum speed by piloting the lifting of the valve by controlling the position of the mobile swivel pin 21D for the rocker arm 20D.

FIG. 8 depicts a dynamic variable flow pressure reducing device according to the invention where it is possible to see a compressed gas tank 30 linked to a use capacity 31 of this gas expanded to its use pressure, by a pipe 26 sealed by a valve 24. The opening of the aforesaid valve is controlled by a device comprising a camshaft 16D driven by an electric motor 1E, and a rocker arm 20D pivoting around a mobile pin 21. The position of the aforesaid mobile pin, used to vary the lifting of the valve 24, and consequently, the flowrate of the compressed air let in, is controlled by a yoke 23. The rocker arm 20D comprises a slotted hole 22, wherein the mobile swivel pin 21 is mounted, The end of the aforesaid rocker arm 20D furthest from the camshaft 15D activates a valve 24 via a pushrod 26D. During the rotation of the camshaft 15D, the rocker arm 20D pivots around its mobile pin 21 and opens the valve 24 authorizing an amount of the compressed air contained in the storage tank 30 to be let into the buffer capacity 31. According to the pressures prevailing in the tank 30 and the capacity 31, the lifting of the valve 24 will be regulated either to keep the valve closed for a zero flowrate, or to let a greater or lesser amount of compressed air into the capacity 31, making it possible to maintain the required pressure in the latter, The rotation speed of the electric engine 15E for driving the camshaft 15D will also be taken into account for improving the accuracy of the amount of compressed air let into the buffer capacity 31.

The means for driving the camshaft 15D, and controlling the yoke can be mechanical, electronic, hydraulic or other without changing the described invention in any way.

The invention is not restricted to hew embodiments described and depicted: the equipment, the means of control, the devices described can vary subject to them being equivalent, and producing the same results, without changing the invention which has just been described hereinabove in any way.

The invention claimed is:

1. A flow pressure reducer and distribution system for compressed air injection engines operating on mono or dual energy with a dual or triple supply mode and comprising:

a high-pressure compressed air tank;

a buffer capacity positioned in line with said high-pressure compressed air tank and arranged to supply compressed air to at least one piston;

a first valve assembly arranged to regulate a supply of compressed air in said buffer capacity, said first valve assembly comprising:

a first valve;

a first rocker arm rod arranged to be controlled by a cam positioned directly on a flange of a crankshaft; and a first rocker arm arranged to receive driving thrust from said first rocker arm rod and arranged to activate said first valve, wherein said first valve is pivotable around a first mobile pin that is movable between two ends of said first rocker arm to change a lever arm ratio of said first valve and thereby determine lifting of said first valve according to movement of said first rocker arm rod; and at least one additional valve assembly arranged to regulate a supply of compressed air to said at least one piston, said at least one additional valve assembly comprising:

an additional valve;

an additional rocker arm rod arranged to be moved by a pressure lever that is controlled by said cam; and an additional rocker arm arranged to receive driving thrust from said additional valve rocker arm rod and arranged to activate said additional valve, wherein said additional valve is pivotable around an additional mobile pin that is movable between two ends of said additional rocker arm to change a lever arm ratio of additional rocker arm and thereby determine lifting of said additional valve according to movement of said additional rocker arm rod.

2. The flow pressure reducer and distribution system of claim 1, wherein:

said first rocker arm is essentially arc-shaped, and said first rocker arm has a first end which activates said first valve and a second end which is linked to said first rocker arm rod and pivots around said first mobile pin;

said first mobile pin is arranged to move in an arc-shaped slotted hole in said first rocker arm along a path that is essentially concentric with said first rocker arm;

said additional rocker arm is essentially arc-shaped, and said additional rocker arm has a first end which activates said additional valve and a second end which is linked to said additional rocker arm rod and pivots around said additional mobile pin; and said additional mobile pin is arranged to move in an arc-shaped slotted hole in said additional rocker arm along a path that is essentially concentric with said additional rocker arm.

3. The flow pressure reducer and distribution system of claim 2, wherein:

a contact area of said first rocker arm on the first valve is made up of an arc of a circle having as its axis a position of said first mobile pin when said first rocker arm is in a position close to said first valve thus enabling said first rocker arm to pivot on said first mobile pin to stop exerting pressure on said first valve and keep said first valve closed during pivoting of said first rocker arm; and a contact area of said additional rocker arm on said additional valve is made up of an arc of a circle having as its axis a position of said additional mobile pin when said additional first rocker arm is in a position close to said additional valve thus enabling said additional rocker arm to pivot on said additional mobile pin to stop exerting pressure on said additional valve and keep said additional valve closed during pivoting of said additional rocker arm.

4. The flow pressure reducer and distribution system of claim 2, wherein:

said first mobile pin is controlled by a first rotating, pivoting yoke supporting said first mobile pin and being mounted so as to have the same radius as said arc-shaped slotted hole in said first rocker arm; and said additional mobile pin is controlled by an additional rotating, pivoting yoke supporting said additional mobile pin and being mounted so as to have the same radius as said arc-shaped slotted hole in said additional rocker arm.

5. An appliance requiring compressed gas expansion, said appliance comprising the flow pressure reducer and distribution system of claim 2.

6. The flow pressure reducer and distribution system of claim 1, wherein:

a contact area of said first rocker arm on the first valve is made up of an arc of a circle having as its axis a position of said first mobile pin when said first rocker arm is in a position close to said first valve thus enabling said first rocker arm to pivot on said first mobile pin to stop exerting pressure on said first valve and keep said first valve closed during pivoting of said first rocker arm; and a contact area of said additional rocker arm on said additional valve is made up of an arc of a circle having as its axis a position of said additional mobile pin when said additional first rocker arm is in a position close to said additional valve thus enabling said additional rocker arm to pivot on said additional mobile pin to stop exerting pressure on said additional valve and keep said additional valve closed during pivoting of said additional rocker arm.

7. The flow pressure reducer and distribution system of claim 6, wherein:

said first mobile pin is controlled by a first rotating, pivoting yoke supporting said first mobile pin and being mounted so as to have the same radius as said arc-shaped slotted hole in said first rocker arm; and said additional mobile pin is controlled by an additional rotating, pivoting yoke supporting said additional mobile pin and being mounted so as to have the same radius as said arc-shaped slotted hole in said additional rocker arm.

8. An internal combustion engine comprising the flow pressure reducer and distribution system of claim 6.

9. The flow pressure reducer and distribution system of claim 1, wherein:

said first mobile pin is controlled by a first rotating, pivoting yoke supporting said first mobile pin and being mounted so as to have the same radius as said arc-shaped slotted hole in said first rocker arm; and said additional mobile pin is controlled by an additional rotating, pivoting yoke supporting said additional mobile pin and being mounted so as to have the same radius as said arc-shaped slotted hole in said additional rocker arm.

10. The flow pressure reducer and distribution system of claim 9, wherein:

said first rotating, pivoting yoke and said additional rotating, pivoting yoke are controlled by mechanical means directly linked to an accelerator making it possible to gradually supply said buffer capacity and engine cylinders according to required engine power.

11. An internal combustion engine comprising the flow pressure reducer and distribution system of claim 10.

12. The flow pressure reducer and distribution system of claim 9, wherein:

said first rotating, pivoting yoke and said additional rotating, pivoting yoke are controlled by electric means and an electronic control system which takes into account pressure in the buffer capacity as well as pressure in the compressed air tank so as to maintain said pressure in said buffer capacity virtually constant.

13. An internal combustion engine comprising he flow pressure reducer and distribution system of claim 12.

14. The flow pressure reducer and distribution system of claim 9, wherein:

said first rotating, pivoting yoke and said additional rotating, pivoting yoke are controlled via electric means and an electronic control system used with a suitable cartography to control lifting of said first valve and said additional valve for all selected parameters according to: a position of the accelerator, requested torque, required speed or other specified conditions.

15. An internal combustion engine comprising the flow pressure reducer and distribution system of claim 14.

16. An internal combustion engine comprising the flow pressure reducer and distribution system of claim 9.

17. A flow pressure reducer and distribution system for compressed air injection engines operating on mono or dual energy with a dual or triple supply mode and comprising:

a high-pressure compressed air tank;

a buffer capacity positioned in line with said high-pressure compressed air tank and arranged to supply compressed air to at least one piston;

a first valve assembly arranged to regulate a supply of compressed air in said buffer capacity, said first valve assembly comprising:

a first valve; and a first rocker arm controlled by a first overhead camshaft that is driven by mechanical means or other means linked to engine rotation, said first rocker arm having a first end arranged to receive driving thrust from a first cam on said first overhead camshaft and said first rocker arm having a second end arranged to activate said first valve, wherein said first rocker arm is pivotable about a first mobile pin that is movable between said first and second ends of said first rocker arm to change a lever arm ratio of said first rocker arm and thereby determine lifting of said first valve according to movement of said first rocker arm rod; and at least one additional valve assembly arranged to regulate a supply of compressed air to said at least one piston, said at least one additional valve assembly comprising:

an additional valve; and an additional rocker arm controlled by an additional overhead camshaft that is driven by said mechanical means or said other means linked to said engine rotation, said additional rocker arm having a first end arranged to receive driving thrust from an additional cam on said additional overhead camshaft and said additional rocker arm having a second end arranged to activate said additional valve, wherein said additional rocker arm is pivotable about an additional mobile pin that is movable between said first and second ends of said additional rocker arm to change a lever arm ratio of said additional rocker arm and thereby determine lifting of said additional valve according to movement of said additional rocker arm rod.

18. The flow pressure reducer and distribution system of claim 17, wherein said first camshaft and said additional camshaft are driven by an independent electric motor capable of being piloted by rotation speed.

19. An appliance requiring compressed gas expansion, said appliance comprising the flow pressure reducer and distribution system of claim 17.

20. An internal combustion engine comprising the flow pressure reducer and distribution system of claim 17.

* * * * *